US006007356A

United States Patent [19]

Stein

[11] Patent Number: 6,007,356

[45] Date of Patent: Dec. 28, 1999

[54] WATER TIGHT QUICK CONNECT ELECTRICAL CONNECTOR

[76] Inventor: Myron Stein, 31412 Flying Cloud, Leguna Niguel, Calif. 29677

[21] Appl. No.: 09/109,567

[22] Filed: Jul. 2, 1998

[51] Int. Cl.[6] ..... H01R 13/28

[52] U.S. Cl. ..... 439/284; 439/930

[58] Field of Search ..... 439/930, 725, 439/787, 708; 174/93, 84 R, 85 R, 75 R

[56] References Cited

U.S. PATENT DOCUMENTS

| | | | |
|---|---|---|---|
| 939,501 | 11/1909 | Hinds | 403/308 |
| 1,751,572 | 3/1930 | Beemer | 439/784 |
| 1,941,715 | 1/1934 | Pfisterer | 439/784 |
| 2,001,131 | 5/1935 | Guhl | 173/263 |
| 2,009,090 | 7/1935 | Little | 173/263 |
| 2,064,440 | 12/1936 | Meeker | 173/303 |
| 3,079,459 | 2/1963 | Abbott | 174/91 |
| 3,786,173 | 1/1974 | Vogt | 174/88 |
| 4,070,543 | 1/1978 | Thompson et al. | 174/87 |
| 4,204,739 | 5/1980 | Shoenleben | 339/75 |
| 4,720,275 | 1/1988 | Swart et al. | 439/725 |
| 4,874,909 | 10/1989 | Velke, Sr. et al. | 174/845 |
| 5,228,875 | 7/1993 | Swenson, Sr. | 439/784 |
| 5,502,280 | 3/1996 | Rocci et al. | 174/84 |
| 5,542,861 | 8/1996 | Anhalt et al. | 439/578 |

*Primary Examiner*—Renee S. Luebke
*Assistant Examiner*—V. Johnson
*Attorney, Agent, or Firm*—Womble Carlyle Sandridge & Rice

[57] ABSTRACT

A water tight quick connect electrical connector is provided for electrically coupling the ends of two conductors together. The connector includes a cylindrical plastic sleeve and a pair of generally cylindrical inserts insertable in the open ends of the sleeve. Each insert has an angled face and is formed with a longitudinal passageway that terminates on the angled face of the insert. In use, conductors are inserted through the passageways of the inserts until their bared ends are exposed on the angled faces of the inserts. The inserts are then pressed into the sleeve until their angled faces engage each other and the bared ends of the conductors are pressed together and held in firm engagement between the faces to form an electrical connection. Locking ribs on the inserts and locking grooves on the inside of the sleeve lock the inserts in place and form a water tight seal.

15 Claims, 3 Drawing Sheets

WATER TIGHT QUICK CONNECT ELECTRICAL CONNECTOR

TECHNICAL FIELD

The present invention relates generally to electrical wiring and more specifically to electrical connectors for electrically coupling together the bared ends of two electrical conductors.

BACKGROUND OF THE INVENTION

Electrical wiring in general and automotive electrical system wiring in particular often calls for two wires or conductors to be spliced together to form part of an electrical circuit. Such a requirement arises often in the case of automotive wiring systems when, for example, components such as blowers, sound systems, and other electric and electronic components are removed for repair and then replaced. In many such instances, the original wiring to and from such components must be cut in order to remove the component and then re-spliced when the component is installed again. A variety of other instances also occur during maintenance and indeed during fabrication of all types of vehicles in which wires must be spiced or electrically connected together. In marine environments, for example, wires often must be connected in locations where the connection will be exposed to corrosive moisture such as salt water, fuel oil, or the like. Even in residential and commercial housing, electrical connection of two wires is often required.

A number of connectors have been developed for splicing or connecting wires together. One of the most venerable, for example, is the traditional wire nut, wherein the bare ends of two or more wires are twisted together and an internally spiral threaded nut is twisted or screwed onto the wire ends to hold the ends in tight electrical contact. While such wire nuts are very common and have been used for many years, in commercial and residential wiring, they nevertheless exhibit serious shortcomings in some environments such as in automotive and marine wiring systems. Specifically, in such applications, wire nuts tend to be too bulky to fit into the small tight areas through which the wires often extend. Further, wire nits are not "in line" connectors; that is, the wires, when connected together, are not collinear with each other but rather enter in parallel at the open end of the wire nut. This contributes to the space problem mentioned above and also requires that there be substantial slack in the wires so that their ends can be twisted together. In many cases, the necessary slack is simply not available, particularly in automotive and marine applications. Finally, wire nuts do not create a sealed water tight connection. As a result, they are particularly inapplicable to use in marine applications such as in the wiring systems of boats and ships.

In line electrical connectors have also been developed. Examples of such connectors are disclosed in U.S. Pat. Nos. 2,001,131 of Guhl, 3,079,459 of Abbott, 3,786,173 of Vogt, 4,874,909 of Velke, Sr. et al., and 5,502,280 of Rocci et al. While these devices represent various attempts to create in line electrical connectors that are quick connecting and in some instances provide a sealed connection, they nevertheless exhibit various problems and shortcomings inherent in their respective designs. Guhl for example teaches a pair of threaded sleeves that, when threaded onto jaws that embrace the wires, cause the jaws to close on the wires. However, such an arrangement does not couple the wires directly to each other, is difficult to install, and does not form a water tight connection. In the Abbott connector, the bared frayed ends of two wires are brought together in the connector, but are held only loosely together resulting in junction resistance. This device, too, is cumbersome and difficult to install and forms a sealed connection only through the use of clamps that must be installed and tightened.

In Vogt, the ends of two wires are aligned in the connector and are electrically coupled by a metal pin, which pierces the wires to engage the bare conductors therein. No water tight seal is formed and the wires are not connected directly together but only through an ancillary pin. This can and often does result in unwanted electrical resistance at the connection. In Velke the bared ends of two wires are overlapped in a connector housing and the housing is twisted to wrap the ends tightly in a coiled metal gripping element that wraps tightly around the overlapped ends. This approach is interesting, but nevertheless does not form a water tight connection and is subject to degradation over time as the gripping element loosens under the influence of vibration, movement, or stress on the connectors.

Thus, a need exists for an electrical connector that is of the compact in line type, that is quick and easy to install in only a very few steps, that forms a permanent water tight electrical connection between two conductors, and that is economical to manufacture and reliable in use. It is to the provision of such an electrical connector that the present invention is primarily directed.

SUMMARY OF THE INVENTION

Briefly described, the present invention, in one preferred embodiment thereof, comprises an improved in-line electrical connector for electrically coupling the ends of two connectors together to form an electrical circuit. The connector comprises a generally cylindrical sleeve, preferably formed of plastic material, having a first open end and a second open end. A first insert, also made of plastic material, is sized to be insertable in the first open end of the sleeve and is formed with a substantially flat angled face on its interior end. A second similar insert is sized to be inserted in the second open end of the sleeve and also defines a substantially flat angled face on its interior end. The angled face of the first insert is configured to abut and be juxtaposed with the angled face of the second insert when the inserts are inserted into their respective ends of the cylindrical sleeve and pressed together with a pliers-like tool. In one embodiment, an array of annular grooves are formed in the inner wall of the cylindrical sleeve adjacent its ends and a corresponding set of annular ribs are formed on each of the inserts. When the inserts are inserted and pressed into the sleeve, the annular ribs engage the annular grooves to lock the inserts in place with their flat faces held firmly together within the sleeve.

Each of the inserts has a generally longitudinally extending passageway formed therethrough for receiving the end of one of the wires or conductors to be electrically joined. The passageway in each insert terminates on the angled flat face of the insert and is positioned such that a bared portion of the end of the conductor is exposed and extends along the face. Preferably, an indented bed is formed along each angled face for receiving and properly positioning the bared end of the respective conductor.

The angled faces and the beds formed therein are configured and positioned such that the exposed bared ends of the conductors on the flat faces of the inserts are brought into and held in tight electrical contact with each other between the angled faces of the inserts when the inserts are inserted into the respective open ends of the sleeve and pressed together. In this way, a reliable secure electrical connection is made between the bared ends of the wires because they are held in firm contact substantially along their entire lengths between the faces of the inserts.

In a preferred embodiment, the cylindrical sleeve of the present invention is formed of a relatively harder rigid plastic material such as Teflon and the inserts are formed of a relatively softer more deformable plastic material. The passageways formed through the inserts are initially sized to be just slightly larger than the diameter of the insulation that surrounds the conductors to be coupled. In use, a predetermined length of the insulation is stripped away on the end of each conductor and the conductors are inserted through the passageways of their respective inserts until the stripped ends of the conductor can be bent to lie against the angled face and the insulation of the conductor is disposed within the passageway. When the inserts are pressed in the passageway, the bared wire ends are brought together as discussed above and the inserts, being made of a more pliable plastic, compress slightly to embrace, capture, and seal around the insulation. In this way, a water tight seal is formed between the inserts and the conductors to prevent water and other moisture from migrating into the connector. The connector of the present invention is thus suitable for use in marine or other moist or wet environments.

The connector of the present invention provides many benefits over connectors of the prior art, particularly in automotive use. For example, the in-line nature of the connector is not bulky and fits easily within tight or crowded compartments and also requires minimum slack in the wires that are to be connected. The connector is easy to apply to the ends of two wires and easily engaged with a pliers-like tool that forces the inserts into the sleeve until the wires make electrical connection between the angled faces of the inserts. The connector is water tight and particularly suited to use in hostile environments where prior art connectors cannot be used.

Thus, it is an object of this invention to provide an improved electrical connector that can couple two conductors together quickly and easily.

Another object of the invention is to provide an improved electrical connector that requires minimum slack between the two wires to be connected.

A further object of the invention is to provide an electrical connector that is water tight for use in marine and other hostile environments.

A still further object of the invention is to provide an automotive electrical connector that is economical to manufacture, easy to use, and that forms highly reliable electrical connections that do not deteriorate over time.

These and other objects, features, and advantages of the present invention will become more apparent upon review of the detailed description set forth below when taken in conjunction with the accompanying drawings, which are briefly described as follows.

DETAILED DESCRIPTION OF THE PREFERRED EMBODIMENT

Figure 1:
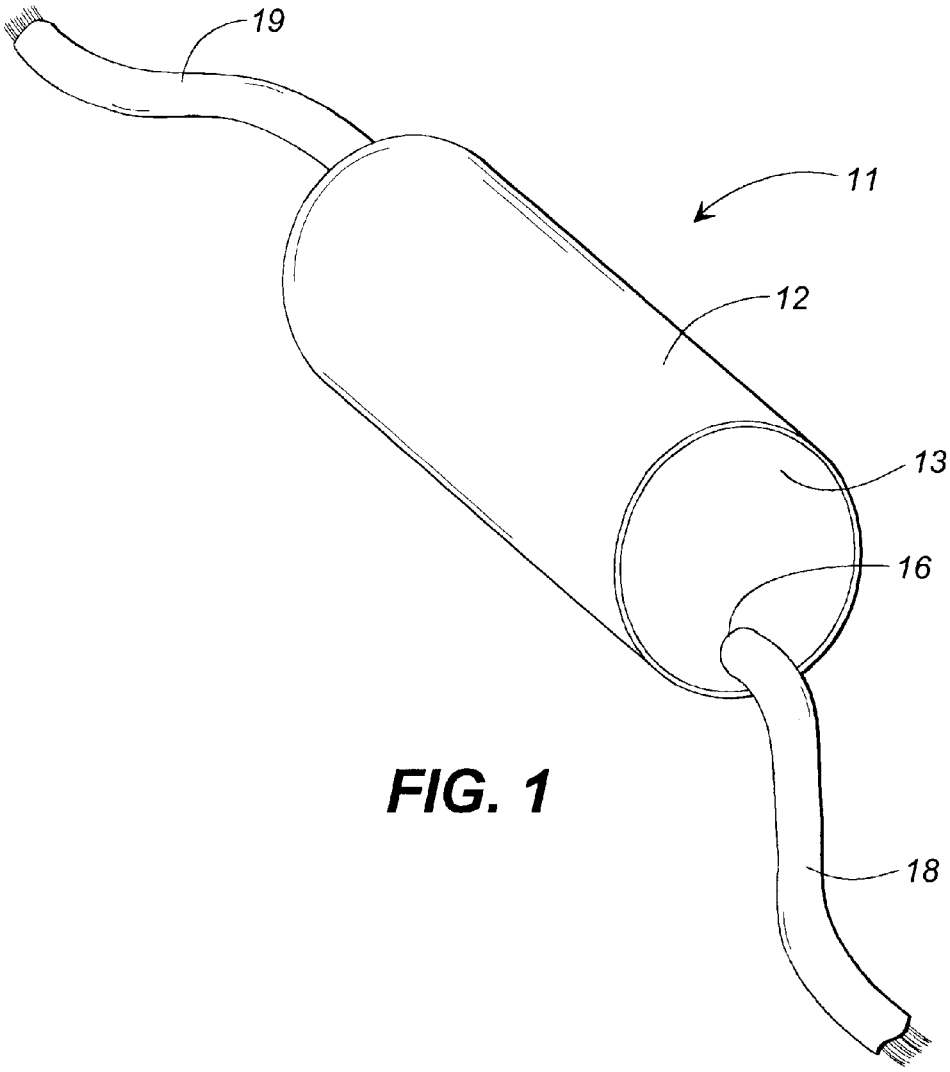
FIG. 1 is a perspective view of an electrical connector that embodies principles of the invention in a preferred form and shown installed and coupling two conductors or wires together.

Referring now in more detail to the drawings, in which like numerals refer to like elements throughout the several views, FIG. 1. illustrates the electrical connector of the present invention in perspective view as it appears when electrically coupling two conductors together. The connector 11 comprises a cylindrical outer sleeve 12 having opposed open ends 8 and 9. The sleeve 12 preferably is fabricated of a relatively hard rigid non conducting plastic material such as, for example, Teflon. However, other appropriate materials might also be selected depending on the requirements of a particular application.

A first insert 13 having a butt end 15 is seen inserted in the open end 8 of the sleeve 12 with the butt end 15 of the insert exposed. Although not visible in FIG. 1, a second insert 14 (FIG. 2) having a butt end 7 is inserted in the other open end 9 of the sleeve and its butt end is exposed the same as butt end on the sleeve's open end 8.

The first insert 13 has a generally longitudinally extending passageway 16 that is offset from the central axis of the first insert and extends therethrough. The passageway 16 is sized to receive and house a first electrical conductor 18, which extends through the passageway. It will be understood that the conductor 18 comprises internal conducting wires covered by rubberized or plastic insulation. The passageway 16 has a diameter that normally is slightly larger than the diameter of the insulation of the conductor 18, for purposes described in more detail below.

Figure 2:
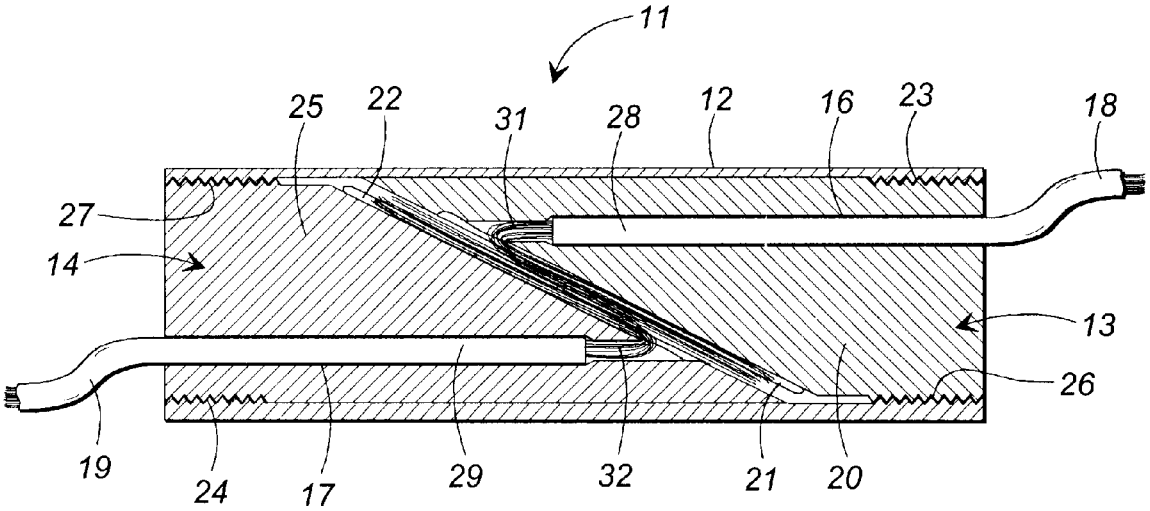
FIG. 2 is a longitudinal sectional view of the connector of FIG. 1 showing the configuration and relationship of the various elements thereof.

Similarly, the second insert 14 (FIG. 2) is formed with a radially offset longitudinal passageway 17 for receiving and housing a second conductor 19. The inserts 13 and 14 are mirror images of and complement each other as best illustrated in FIG. 2. It is apparent from FIG. 1 that the electrical connector of this invention in an "in-line" connector. That is, when installed, the connector is substantially coextensive with the two conductors that it couples together. This provides the smallest and least intrusive profile so that the connector can easily be used in applications where space is tight.

FIG. 2 is a longitudinal sectional view of the electrical connector of this invention taken along A—A of FIG. 1. The cylindrical sleeve 12 is seen to have an internal wall 30 that defines an central passageway of the sleeve 12 with the passageway terminating in open ends 8 and 9. A portion of the internal wall 30 adjacent to open end 8 is formed with an array of annular locking grooves 23 and a portion of the internal wall 30 adjacent the open end 9 is formed with a similar array of annular locking grooves 24. The annular locking grooves 23 and 24 extend circumferentially around their respective portions of the internal wall 30.

First insert 13 has a generally cylindrical body portion 20 that terminates on the right in FIG. 2 in butt end 15. The opposite end of the first insert is cut or formed at an acute angle to form an oblately shaped angled flat face 21 of the insert 13 that resides inside the sleeve 12 when the insert is inserted therein. Similarly, the second insert 14 has a generally cylindrical body portion 25 that terminates on the left in FIG. 2 in butt end 7. The opposite end of the second insert 14 is cut or formed to define an oblately shaped angled flat face 22 that resides inside the sleeve 12. The angles at which the faces are formed are complimentary with respect to the central axis of the sleeve 12. With this configuration, the flat faces 21 and 22 of the first and second inserts face one another and are juxtaposed within the sleeve 12. It can thus be said that the flat faces 21 and 22 of the inserts are complementary and juxtaposed within the sleeve 12 when they are inserted in respective open ends 8 and 9 thereof.

The first insert 13 is formed with a passageway or bore 16 that extends through the first insert from the butt end 15 to the angled face 21 thereof. The passageway 16 is longitudinally oriented and is offset from the axis of the first insert in such a way that the passageway terminates on the angled flat face 21 at a position adjacent the acute end thereof. The second insert 14, which is a mirror image of the first insert 13, is formed with a passageway or bore 17 that extends through the second insert from the butt end 7 to the angled face 22 thereof. As with the passageway of the first insert, the passageway 17 is longitudinally oriented and is offset from the axis of the second insert so as to terminate on the angled flat face 22 at a position adjacent the acute end thereof.

An array of annular ribs 26 are formed around the body of the first insert 13 adjacent the butt end 15 thereof. A similar array of annular ribs 27 are formed around the body of the second insert 14. The body portions 20 and 25 of the first and second inserts have an external diameter that preferably is slightly larger than the inner diameter of the passageway 30 of the sleeve 12. Further, the inserts 13 and 14 preferably are formed from a plastic material that is softer and more deformable than the plastic material from which the sleeve is fabricated. With such a configuration and construction, when the inserts 13 and 14 are pressed into their respective ends of the sleeve, a tight friction fit is formed between the inserts and the sleeve. In addition, since the material of the inserts is softer and more compressible than the material of the sleeve, the inserts are progressively compressed slightly as they advance into the sleeve such that the passageways 16 and 17 constrict and become slightly smaller. Eventually, the arrays of annular ribs 26 and 27 on the inserts engage the respective arrays of annular locking grooves 23 and 24 in the inner wall of the sleeve and further advancement of the inserts lock the ribs and grooves together so that the inserts are securely locked in place within the sleeve. In addition, the annular ribs and locking grooves mate to form a water tight junction or seal between the inserts and the sleeve to prevent migration of moisture into the electrical connector.

A first conductor 18 has a bared end portion and extends through the passageway 16 formed in the first insert 13. As can be seen in FIG. 2, the bared end portion 31 projects out of the internal end of the passageway 16 and is bent back to lie along the angled flat face 21 of the first insert. The unremoved insulation on the conductor 18 resides within the passageway 16 for most of the length thereof. The second conductor 19 has a bared end portion 32 and extends through the passageway 17 of the second insert 25 with the insulation of the conductor disposed in the passageway and the bared end portion projecting from the passageway and bent back to lie along the angled flat face 22 of the second insert. With this configuration, it will be seen that the bared ends 31 and 32 of the conductors 18 and 19, respectively, are captured between the flat faces of the inserts within the sleeve where they are compressed tightly together to form an electrical connection between the conductors. This electrical connection is virtually resistance free and is highly reliable because relatively large surface areas of the two bared ends of the conductors are in contact and pressed tightly together.

Furthermore, as mentioned above, as the relatively softer inserts are inserted through the sleeve with the conductors disposed in their respective passageways, the passageways constrict around and securely capture the insulation of the conductors. This provides at least two benefits. First, the insulation of the conductors is held firmly in place within the inserts so that the conductors cannot be pulled out of the connector and any stress caused from pulling or vibration is born by the insulation and not by the metal wires within the conductor. Second, because the insulation of the conductor is generally a rubberized or soft plastic material, the constriction of the passageways 16 and 17 around the insulation creates a water tight seal between the inserts and the conductors. Thus, since the only two places where moisture might seep into the connector are sealed, a water tight assembly is formed when the inserts with their conductors are pressed in the sleeve. In addition, the sealing of the components occurs automatically as the inserts are advanced into the sleeve so that no ancillary gaskets or seals are required. Accordingly, the present invention is particularly suited to use in marine and other environments where water or moisture are prevalent.

Figure 3:
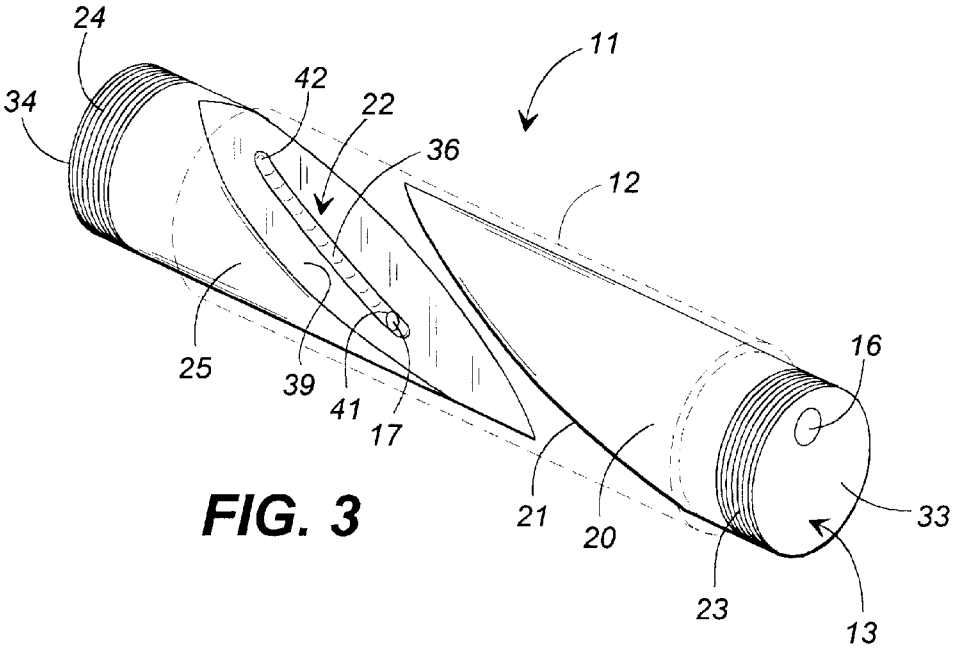
FIG. 3 is a partially exploded perspective view with the sleeve shown in phantom lines illustrating the angled faces and beds of the inserts.

FIG. 3 illustrates better the configuration of the angled flat faces of the inserts of this invention. The inserts 13 and 14 are shown partially inserted into the sleeve 12, which is shown in phantom lines in FIG. 3 for clarity. Only the angled face 22 of the second insert 14 is visible in FIG. 3; however, it will be understood that the face 21 of the first insert 13 is formed the same as face 22 but is a mirror image of and complementary with respect thereto. Accordingly, the following description of the angled face 22 applies equally to the angled face 21 of the first insert.

The angled face 22 is seen to be generally oblately shaped and substantially flat. The offset passageway 17 terminates adjacent the acute end of the angled face, or, in other words, the end most distant from the butt end of the insert. A trough or bed 36 is formed along the central axis of the angled face 22 and extends between a first end portion 41, which intersects the end of the passageway 17, and a second end portion 42 located adjacent the obtuse end of the angled face.

Preferably, the bed 36 has a depth that is less than the thickness of the bared end of a conductor so that when the bared end is bent back to lie along the angled face, it rests in and is properly positioned by the bed but nevertheless projects outwardly therefrom a predetermined small distance. In the preferred embodiment, the angled face 22, as well as the hidden angled face 21, is provided with a conductive coating or cladding 39, which is bonded to and covers the surface of the angled face as well as the surface of the bed 36.

As described above, the first and second inserts 13 and 14 have substantially cylindrical body portions 20 and 25 respectively and terminate in respective butt ends 15 and 7 (best illustrated in FIG. 2). A portion of the bodies 20 and 25 adjacent the butt ends 15 and 7 are provided with annular locking grooves 23 and 24 for sealingly locking with the annular locking ribs at the end portions of the sleeve 12. As can be seen from FIG. 3, as the first and second inserts 13 and 14 are pressed toward each other within the sleeve 12, their complementary angled faces 21 and 22 eventually come in or very close to contact with each other within the interior of the sleeve 12.

Figure 4:
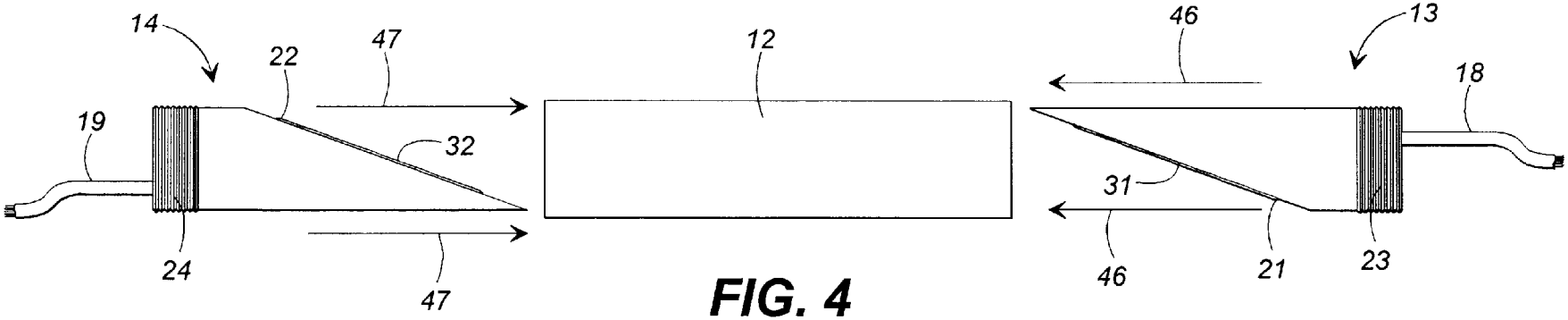
FIG. 4 is a side elevational exploded view showing insertion of the inserts into the sleeve to complete the electrical connection.

FIG. 4 illustrates insertion of the first and second inserts 13 and 14 into the sleeve 12 for coupling two conductors 18 and 19 together at their respective bared ends 31 and 32. In reality, the inserts preferably are pressed into the sleeve with a specially designed set of pliers that engage the butt ends of the inserts and press them firmly and forcefully into the sleeve. Prior to insertion into the sleeve, the ends of the two conductors 18 and 19 are stripped to reveal bare wires of a length approximately the same as or slightly less than the length of the beds formed in the angled faces of inserts. The conductors are then inserted through the passageways 16 and 17 (FIG. 2) until their bared ends protrude from the passageways at the acute ends of the respective angled faces.

The bared ends 31 and 32 are then bent upwardly along the angled faces until they lie within the beds formed in the faces. With such preparation complete, the inserts are pressed into the sleeve as shown in FIG. 4. As the angled faces of the inserts approach each other within the sleeve, the bared ends of the conductors engage each other and are then pressed tightly together to form an electrical connection between the conductors. Since the bared ends contact each other and are pressed together along a substantial length, a highly reliable and virtually resistance free electrical connection is created. Further, as the inserts are pressed firmly together, the conductive coatings 38 and 38 on the angled faces also come into contact, further enhancing the integrity of the electrical connection.

As the faces of the inserts are pressed tightly together, the annular locking ribs 23 and 24 on the inserts engage with the annular locking grooves 26 and 27 around the inside of the sleeve and the inserts are thereby locked firmly in place within the sleeve. As mentioned above, the tolerance between the inserts and the sleeve and between the locking ribs and locking grooves preferably is such that this process forms a water tight seal between the inserts and the inside wall of the sleeve. Furthermore, since the inserts are fabricated of a softer plastic material than the sleeve, this process also causes the inserts to compress slightly as they are pressed into the sleeve. This, in turn, causes the passageways 16 and 17 (FIG. 2) to constrict slightly until they embrace tightly and capture the insulation on the conductors extending through the passageways. Thus, a water tight seal is also formed between the walls of the passageways and the conductors. The result is a completely water tight assembly, making the present invention particularly useful in wet or moist conditions, such as in making electrical connections in marine environments or where steam or high humidity are prevalent.

Figure 5:
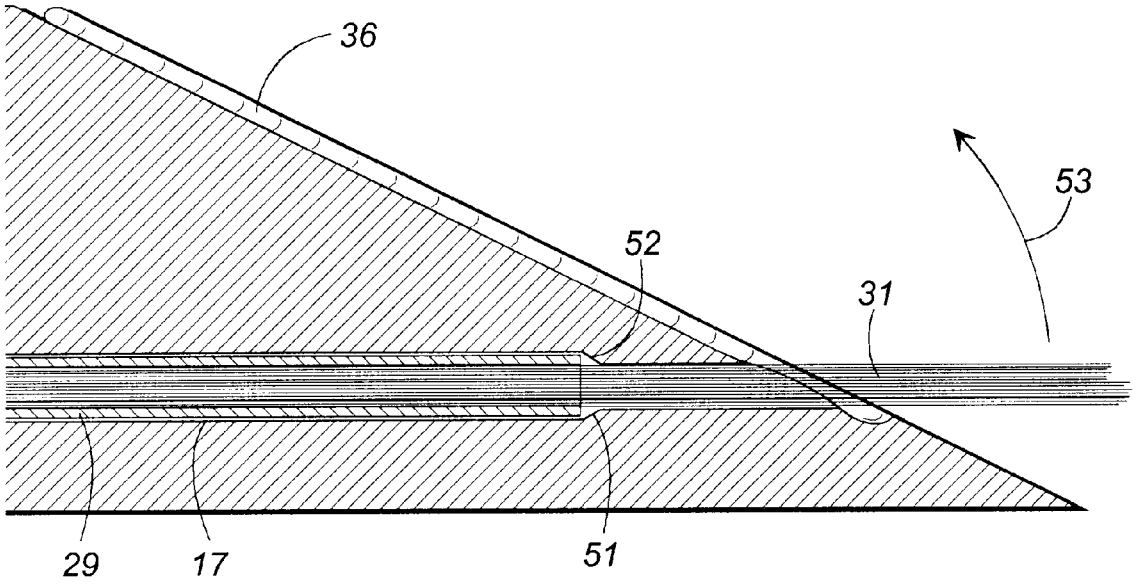
FIG. 5 is a close-up longitudinal sectional view of the end portion of one of the inserts of this invention illustrating the relationship between the passageway and bed of the insert and a wire to be connected.

FIG. 5 is an enlarged longitudinal section of the acute end portion of insert 14 of the present invention. It will be understood that the other insert 13 is a mirror image of the insert 14 shown in FIG. 5. The section of FIG. 5 is taken through the elongated bed 36 formed along the angled face 22 of the insert. The passageway 17 communicates with the bed 36 at the acute end of the angled face 22 and carries conductor 19. The bared end 31 of the conductor protrudes from the end of the passageway 17. The unbared portion of the conductor, which extends through the passageway 17, is covered with vinyl or rubber insulation 29 that terminates in a cut end 52.

A shoulder is preferably formed in the passageway slightly inwardly displaced from its end and defines an end section of the passageway that has a diameter somewhat smaller than the diameter of the remaining length of the passageway. The diameter of the end section of the passageway is large enough to allow the bared end 31 of the conductor to pass through it but too small for the insulation 29 of the conductor to pass through. This insures that when the bare ended conductor is inserted into the insert, only the bared end protrudes from the end of the passageway and the shoulder 51 forms a stop that provides a tactile indication that the conductor has been fully inserted into the passageway.

When the conductor is inserted into the passageway of the insert, the bared end 31 is bend up in the direction of arrow 53 until it lies along the bed 36. The same process is carried out with the other conductor and the other insert, and the inserts are pressed into the sleeve to complete the water tight electrical connection as described above.

The invention has been described and illustrated herein in terms of preferred embodiments. It will be obvious to those of skill in the art, however, that various modifications might well be made to the illustrated embodiments within the scope of the invention. For example, the sleeve and inserts might be made square or rectangular in shape rather than cylindrical, although cylindrical is preferred for ease of manufacture and use. A variety of materials other than plastics might also be chosen for the various components such as, for example, metals, composites, or combinations of such materials with plastics. It is envisioned that the connector of the present invention will be fabricated in a variety of sizes to accommodate a corresponding variety of conductor gauges and sizes, although a "one size fits all" embodiment might well be made. These and other additions, deletions, and modifications to the illustrated embodiments might be made by those of skill in the art without departing from the spirit and scope of the invention as set forth in the claims.

What is claimed is:

1. A connector for electrically coupling ends of two conductors together, said connector comprising:

a sleeve having a first open end and a second open end;

a first insert insertable in said first open end of said sleeve, said first insert being formed with an angled face;

a second insert insertable in said second open end of said sleeve, said second insert being formed with an angled face;

said angled face of said first insert being configured to abut and be juxtaposed with said angled face of said second insert when said inserts are inserted in respective open ends of said sleeve;

a passageway formed in said first insert for receiving an end of one conductor such that a portion of the end of the one conductor is exposed on said angled face of said first insert; and a passageway formed in said second insert for receiving an end of another conductor such that a portion of the end of the other conductor is exposed on said angled face of said second insert;

the exposed ends of the conductors being brought into and held in contact with each other between said angled faces of said inserts when said inserts are inserted into said respective open ends of said sleeve for electrically coupling the ends of the conductors together.

2. A connector as claimed in claim 1 and wherein said sleeve is substantially cylindrical having an interior wall and wherein said first and second inserts have cylindrical body portions sized to form a tight friction fit with said interior wall of said sleeve to hold said inserts firmly in place within said sleeve when inserted therein.

3. A connector as claimed in claim 2 and further comprising arrays of annular locking grooves formed in said interior wall of said sleeve adjacent said open ends thereof and corresponding arrays of locking ribs formed on said cylindrical body portions of said inserts, said locking ribs engaging with said locking grooves when said inserts are inserted in said open ends of said sleeve to lock said inserts in place.

4. A connector as claimed in claim 3 and wherein each of said inserts has a butt end that is exposed when said inserts are disposed within said sleeve and wherein said passageways in said inserts project through said butt ends, said inner wall of said sleeve having a first diameter and said cylindrical body portions of said inserts having a second diameter larger than said first diameter, whereby said passageways constrict against conductors extending therethrough when inserted into said open ends of said sleeve to hold said conductors firmly in place in said passageways and to form a seal between said conductors and said passageways.

5. A connector as claimed in claim 4 and wherein said sleeve and said inserts are formed of plastic.

6. A connector as claimed in claim 5 and wherein said inserts are formed of another plastic that is softer than the plastic from which said sleeve is formed to facilitate the constriction of said passageways when said inserts are inserted into said open ends of said sleeve.

7. A connector as claimed in claim 1 and further comprising a first bed formed in said angled face of said first insert and a second bed formed in said angled face of said second insert, the exposed end portions of the conductors lying in and being positioned and aligned by said first and second beds when said inserts are inserted in said open ends of said sleeve.

8. A connector as claimed in claim 7 and further comprising a layer of conductive material formed on each of said angled faces to enhance the electrical coupling of the end portions of the conductors.

9. An electrical connector for electrically coupling ends of two conductors together, said electrical connector comprising:

a generally cylindrical sleeve having opposed open ends and an inner wall;

a first insert having a substantially cylindrical body portion, an inner end, and an outer end;

a second insert having a substantially cylindrical body portion, an inner end, and an outer end;

said first and second inserts being insertable through respective open ends of said sleeve and being sized and configured such that, when inserted, said inner ends of said inserts abut each other within said sleeve, said cylindrical body portions of said inserts are captured and held in place by said inner wall of said sleeve, and said outer ends of said inserts are exposed at said ends of said sleeve;

a first passageway formed through said first insert extending from said outer end to said inner end thereof for receiving the end of one conductor with a portion of the end of the conductor being exposed on said inner end of said insert;

a second passageway formed through said second insert extending from said outer end to said inner end thereof for receiving the end of another conductor with a portion of the end of the other conductor being exposed on said inner end of said insert;

the exposed ends of the conductors engaging each other between said inner ends of said inserts when said inserts are inserted through said open ends of said sleeve to couple the ends of the conductors electrically together.

10. An electrical connector as claimed in claim 9 and wherein said inner end of said first insert forms an angled face and wherein said inner end of said second insert forms an angled face, said angled faces abutting each other when said inserts are inserted through said open ends of said sleeve, the exposed end portions of the connectors being captured and held together between said angled faces.

11. An electrical connector as claimed in claim 10 and wherein said angled faces of said inserts are each formed with a bed for receiving, positioning, and aligning the ends of the conductors to insure good electrical contact therebetween.

12. An electrical connector as claimed in claim 11 and further comprising a layer of conducting material formed on said angled face of each of said inserts to enhance the electrical contact between the ends of the conductors.

13. An electrical connector as claimed in claim 9 and further comprising locking means for locking said inserts in place within said sleeve.

14. An electrical connector as claimed in claim 13 and wherein said locking means comprises annular locking grooves formed in said inner wall of said sleeve adjacent said open ends thereof and annular locking ribs formed on the cylindrical body portion of each of said inserts, said locking ribs engaging with said locking grooves when said inserts are inserted in said open ends of said sleeve to lock said inserts firmly in place.

15. An electrical connector as claimed in claim 10 and further comprising means for aligning said angled faces as said inserts are inserted through said open ends of said sleeve.

* * * * *